US006575843B2

(12) United States Patent
McCabe

(10) Patent No.: US 6,575,843 B2
(45) Date of Patent: Jun. 10, 2003

(54) METAL WOOD GOLF CLUB HEAD WITH SELECTABLE LOFT AND LIE ANGULATION

(75) Inventor: Terrill R. McCabe, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 73 days.

(21) Appl. No.: 09/974,257

(22) Filed: Oct. 10, 2001

(65) Prior Publication Data

US 2003/0069080 A1 Apr. 10, 2003

(51) Int. Cl.[7] ..... A63B 53/02

(52) U.S. Cl. ..... 473/245; 473/246; 473/248; 473/305; 473/311; 473/314

(58) Field of Search ..... 473/245, 246, 473/287, 288, 305, 306, 307, 308, 309, 310, 311, 312, 313, 314, 315, 248, 244

(56) References Cited

U.S. PATENT DOCUMENTS 1,550,647 A * 8/1925 Mattern
2,067,556 A * 1/1937 Wettlaufer
2,219,670 A * 10/1940 Wettlaufer
3,614,101 A * 10/1971 Hunter
4,854,582 A 8/1989 Yamada
4,948,132 A 8/1990 Wharton
5,042,806 A 8/1991 Helmstetter
5,163,682 A 11/1992 Schmidt et al.
5,318,300 A 6/1994 Schmidt et al.
5,429,355 A * 7/1995 Schmidt et al.
5,439,218 A * 8/1995 Gondeck
5,538,246 A 7/1996 Dekura
5,540,435 A * 7/1996 Kawasaki
5,575,723 A 11/1996 Take et al.
5,766,089 A 6/1998 Dekura
5,839,973 A 11/1998 Jackson
5,888,149 A 3/1999 Allen
5,906,549 A 5/1999 Kubica
6,251,028 B1 6/2001 Jackson

* cited by examiner

*Primary Examiner*—Sebastiano Passaniti

(57) ABSTRACT

A golf club is provided which includes a metal wood club head with a hosel receiving tube that extends from the neck to the sole, and a hosel configured and dimensioned to be received in the hosel receiving tube. The club shaft is received in a bore in the hosel, which may be oriented to produce a desired lie angle and loft. The hosel has an oblong and tapered geometry and is insertable into the tube bore from the sole. The hosel may positively engage the club head, and a ferrule also may be included.

26 Claims, 7 Drawing Sheets

METAL WOOD GOLF CLUB HEAD WITH SELECTABLE LOFT AND LIE ANGULATION

FIELD OF THE INVENTION

The invention relates to a golf club head with selectable loft and lie angulation. More particularly, the invention is related to a multi-piece metal wood golf club head construction including a body with a through-bore and a shaft-receiving hosel disposed therein.

BACKGROUND OF THE INVENTION

Golf players vary in size, dexterity, style, and preference and, therefore, different golf equipment suits the needs of different players. To meet these needs, golf club manufacturers produce clubs in various sizes configurations, including different head sizes, shaft lengths, and weighting. Depending on skill level and personal characteristics, players having the same height and arm length may prefer to use clubs having different shaft lengths for a given head design, or clubs having different head-to-shaft angles and displacements for a given shaft design. Enhanced performance may be realized with equipment having suitably matched shaft length with respect to both the geometric configuration of the head and the individual player characteristics.

Traditional metal wood golf clubs typically include a hollow metal wood head that is secured to a shaft at a shaft-receiving socket, the hosel, which is generally formed on the top back side of the club head. The shaft of such clubs is inserted tightly into the hosel, and epoxy is used to bond the components together. Given the tight fitting sockets of traditional hosel designs, customizing a club to fit a particular golfer usually involves a compromise: the head is chosen to approximate desired angles and displacements, and the shaft length is tailored to the individual regardless of the effect on the optimum ball-striking position of the head.

To obviate such a compromise, a series of club heads may be manufactured with ranges of angles and displacements from which to select. However, the production inefficiencies and concomitant costs for such a club series would be relatively high and manufacturers may be unwilling or unable to provide such variety to the market. In addition, professional golfers occasionally require angles and displacements that are not even available from existing series' molds and thus delivery of custom cast club heads may be unacceptably delayed.

Despite these developments, there remains a need for golf club components hat allow a custom-fit club to be produced. In particular, there is a need for a golf club head that can be formed from several components that may be coupled together based on a layer's ability, preferences, and personal characteristics. More particularly, there is a need for a golf club with a construction permitting selectable lie attitudes and face attitudes.

SUMMARY OF THE INVENTION

The present invention is related to a golf club that includes a metal wood club head with a body having a face, a neck, a crown, and a sole. The golf club also includes a hosel receiving tube having a first portion at the sole and a second portion proximate the neck, a hosel configured and dimensioned to be received in the hosel receiving tube, and an elongate shaft configured and dimensioned to be received in the hosel. The hosel has a substantially oblong and tapered geometry and is insertable into the hosel receiving tube from the sole. The hosel receiving tube may be continuous.

The hosel may further include a top face and bottom face, with the bottom face resting flush with the sole when the hosel is fully disposed in the hosel receiving tube. The neck may further include a top edge, and the top face of the hosel may be disposed below the top edge, proximate the top edge, or above the top edge when inserted into the hosel receiving tube. If the top face of the hosel is above the top edge of the neck, the hosel may extend between about 0.075 inch and about 0.15 inch above the top edge.

The top face and bottom face of the hosel may be disposed in transverse planes. The top face may have a first center point, the bottom face may have a second center point, and a central axis may be disposed along the first and second center points with the shaft being disposed in the hosel bore along a hosel bore axis. The hosel bore axis may be transverse or parallel to the central axis. The hosel may abut a bore in the hosel receiving tube in a single orientation. Using the hosels, the golf club may have a lie angle between about 40° and about 70°. Also using the hosels, the golf club may have a loft of between about 5° and about 40°.

At least one of the hosel receiving tube and sole may be configured and dimensioned to positively engage the hosel. Such positive engagement may be provided by a keyed portion of the hosel receiving tube that mates with a keyway. The hosel may be adhesively secured within the hosel receiving tube, and may be formed of at least one of cellulose, glass-filled ABS, graphite, thermoplastics, titanium, or aluminum.

A ferrule may be provided which is configured and dimensioned to receive the shaft and at least one of the neck and hosel. In some embodiments, the ferrule includes a rounded lower, outer edge, with the outer edge mating with a rounded shoulder proximate a top edge of the neck. The ferrule also may have a straight sidewall.

The hosel may be configured and dimensioned to change the lie of the golf club, the face attitude of the golf club, or both the lie and face attitude of the golf club.

The present invention also is related to a golf club including a metal wood club head with a body having a face, a neck, a crown, and a sole. The golf club also includes a hosel receiving tube having a first portion at the sole and a second portion at the neck, a hosel configured and dimensioned to be received in the hosel receiving tube, an elongate shaft configured and dimensioned to be received in the hosel, and a ferrule having a rounded lower, outer edge, the ferrule being configured and dimensioned to abut the shaft and the neck. The hosel has an oblong and tapered geometry and is insertable into the hosel receiving tube from the sole. The outer edge of the ferrule mates with a rounded shoulder proximate a top edge of the neck.

In addition, the present invention is related to a golf club including a club head with a body having a face, a neck, a crown, and a sole. The golf club also includes a hosel receiving tube having a first portion at the sole and a second portion at the neck. Further, the golf club includes a hosel configured and dimensioned to be received in the hosel receiving tube, the hosel having a substantially oblong and tapered geometry, an upper face defining a first area and a lower face defining a second area. In addition, the golf club includes an elongate shaft configured and dimensioned to be received in the hosel. The hosel is insertable into the hosel receiving tube from the sole, the lower face of the hosel rests flush with the sole when the hosel is inserted into the tube bore, the second area is greater than the first area, and the club head is a driver or a wood.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENTS

Figure 1:
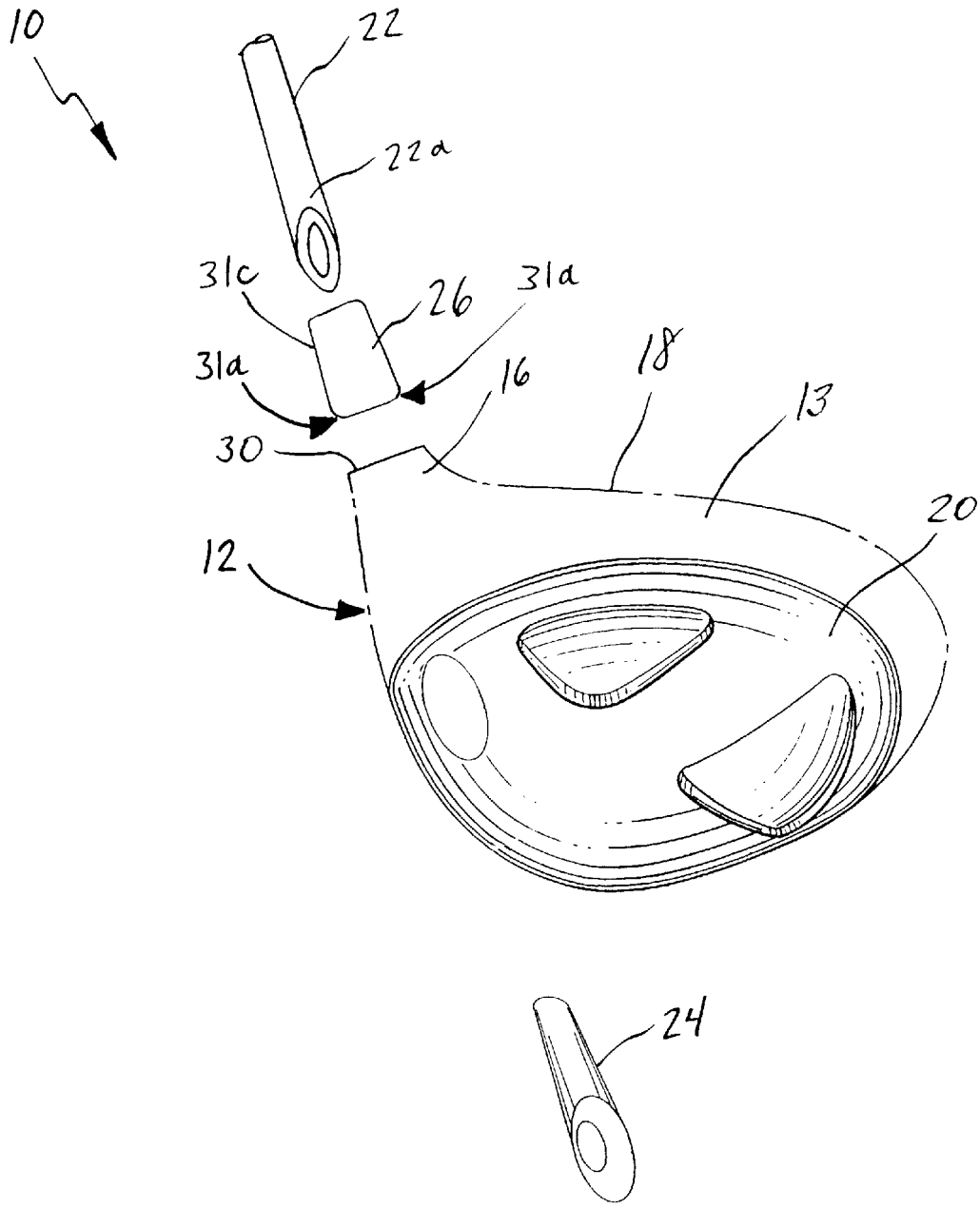
FIG. 1 shows an exploded perspective view of a golf club according to the present invention.
Figure 2:
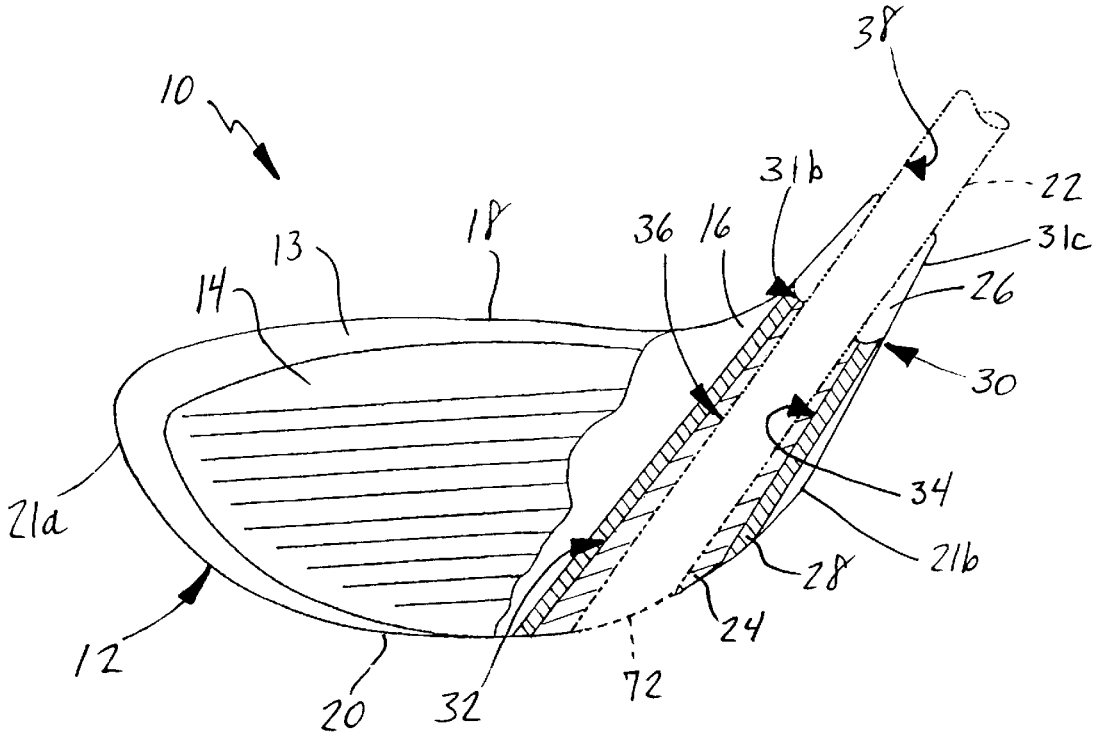
FIG. 2 shows a partial cross-sectional side view of the golf club of FIG. 1.
Figure 3:
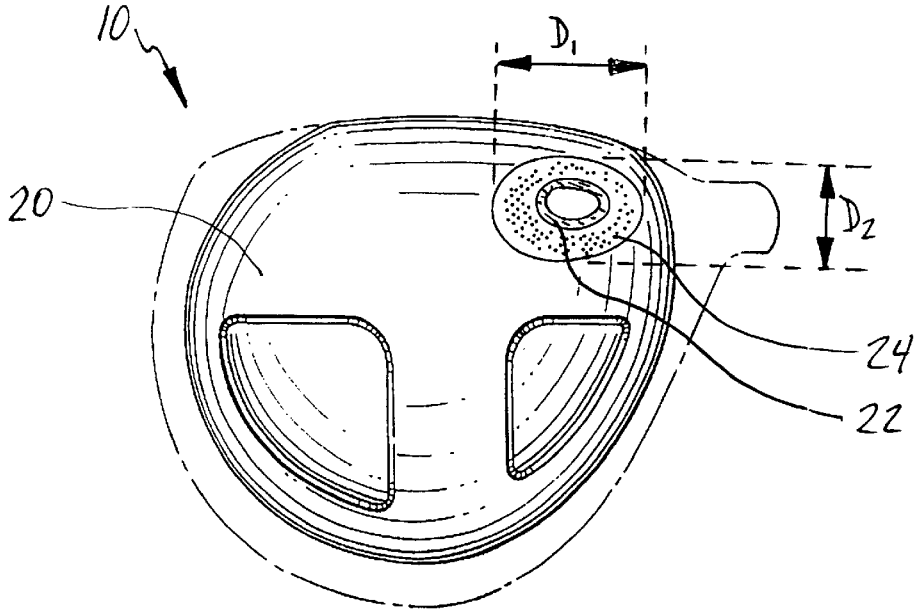
FIG. 3 shows a bottom view of the golf club of FIG. 1.

Referring to FIGS. 1 to 3, a metal wood golf club 10 according to a first embodiment of the present invention is shown. Golf club 10 includes a head 12 with a main body portion 13, a face portion 14 with scoring 15, and a neck portion 16. Head 12 also has a crown portion 18, a sole portion 20, a toe end 21*a* and a heel end 21*b*. Head 12 is coupled to mounting end 22*a* of a shaft 22 with an hosel 24. A ferrule 26 provides a generally smooth transition between shaft 22 and neck portion 16 of head 12. Ferrule 26 also protects the transition region between shaft 22 and neck portion 16 against damage and wear, which should be avoided due to stress concentration in this area. A hosel receiving tube 28, which may be continuous, extends from crown portion 18 to sole portion 20, and ends proximate the upper edge 30 of neck portion 16. Ferrule 26 preferably has a rounded lower, outer edge 31*a* that seats and mates in an internal, like-rounded shoulder 31*b* formed proximate the upper edge 30 of neck portion 16. Side wall 31*c* of ferrule 26 is preferably straight.

In the preferred embodiment, head 12 is formed by stamping, while hosel receiving tube 28 is formed by casting. In an alternate embodiment, both head 12 and hosel receiving tube 28 are cast. Head 12 is preferably formed of metal such as titanium. In the preferred embodiment, face portion 14 is forged from a high strength forging titanium alloy such as 10-2-3 (Ti-10% V-2% Fe-3% Al) or 15-3-3-3 (Ti-15% V-3% Cr-3% Sn-3% Al), or stamped from as-rolled sheet stock. Alternatively, face portion 14 may be cast. Main body portion 13 may be produced from a different titanium alloy from that of face portion 14, preferably by casting a 6–4 alloy (Ti-6% Al-4% V). In alternate embodiments, other forging and casting alloys may be used such as stainless steel and aluminum. By forming face portion 14 by stamping or forging, face portion 14 may be thin yet still have sufficient strength to withstand repeated impact with a golf ball without failure. In turn, by forming face portion 14 as thin as possible while still meeting the desired mechanical performance standards, weight may be redistributed to other parts of club head 12.

Hosel receiving tube 28 is coupled to head 12 by welding, and preferably has a through-bore defining an inner surface 32 that is generally conical in shape, formed by cutting off the top of a cone. In addition, inner surface 32 of hosel receiving tube 28 preferably is not defined by a right cone; in the preferred embodiment, inner surface 32 tapers from sole portion 20 to crown portion 18. Cross-sections of hosel receiving tube 28 preferably have an inner surface 32 that is oblong in shape, with a first inner diameter $D_1$ that is different from a second inner diameter $D_2$. Inner surface 32, for example, may be generally elliptical in shape. Preferably, the concentricity of the cross-sections of hosel receiving tube 28 approaches 1, i.e. a circular geometry, near crown portion 18.

Preferably, hosel 24 has an outer surface 34 that generally conforms to the shape of inner surface 32 of hosel receiving tube 28, such that a close fit is achieved when hosel 24 is received in hosel receiving tube 28. Thus, hosel 24 also is oblong in shape, with a first diameter about the same as $D_1$ and a second diameter about the same as $D_2$. Hosel 24 is provided with a through-bore defining an inner surface 36, and receives shaft 22 therein so that a close fit is achieved between inner surface 36 of hosel 24 and outer surface 38 of shaft 22. Shaft 22 is preferably hollow. Because the mating surfaces of hosel 24 and hosel receiving tube 28 have oblong shapes, hosel 24 cannot freely rotate once fully inserted in hosel receiving tube 28, and thus may be fixed in position. Hosel 24 is preferably formed of a polymer; in some embodiments, hosel 24 may be formed from materials such as cellulose, glass-filled ABS, graphite, thermoplastics, titanium, or aluminum. A hosel 24 is secured within a hosel receiving tube 28 preferably using an adhesive, although other types of securing may be used. Preferably, hosel 24 and shaft 22 are visible on sole portion 20 of club head 12. Advantageously, the use of hosel receiving tube 28 and a hosel 24 provides strong mechanical integrity to head 12.

Figure 4:
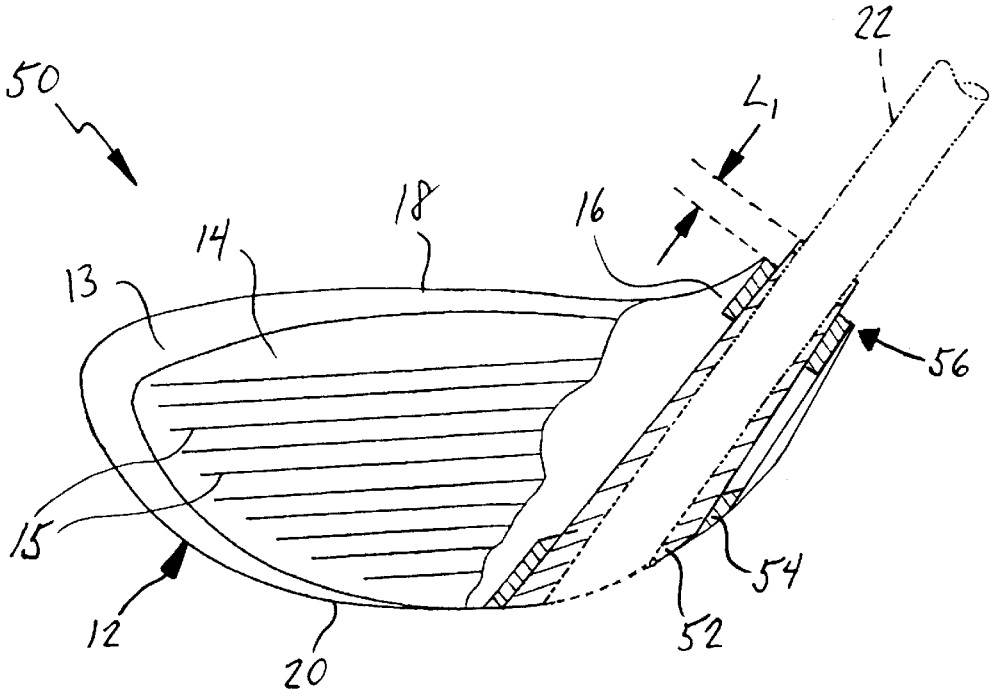
FIG. 4 shows a partial cross-sectional side view of another golf club according to the present invention.
Figure 4A:
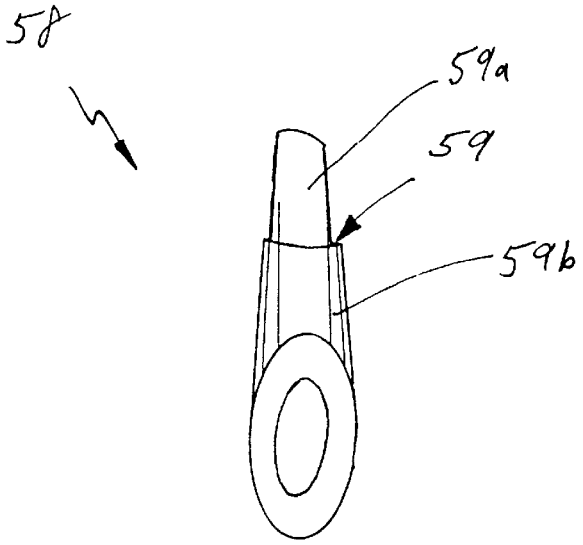
FIG. 4A shows a hosel according to the present invention.

Turning to FIG. 4, a second embodiment of a golf club 50 according to the present invention is shown. Golf club 50 includes a head 12 coupled to a shaft 22 with a hosel 52, which is housed in a hosel receiving tube 54 that extends from crown portion 18 to sole portion 20, and ends proximate the upper edge 56 of neck portion 16. Hosel 52 extends above upper edge 56, preferably between about 0.075 inch and about 0.15 inch, and more preferably about 0.125 inch. A ferrule (not shown) optionally may be provided. In an alternate embodiment, shown in FIG. 4A, a hosel 58 has a shoulder 59, separating upper and lower portions 59*a*, 59*b*, respectively.

Figure 5:
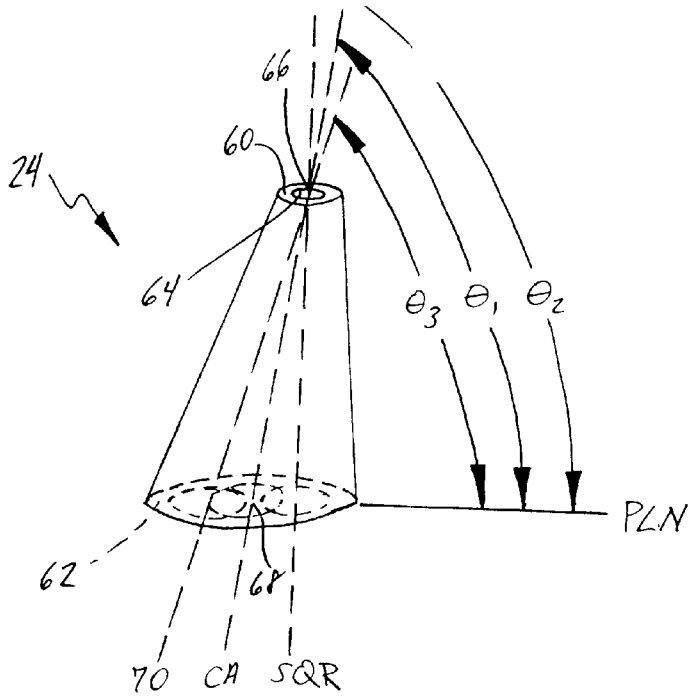
FIG. 5 shows another hosel according to the present invention.
Figure 6:
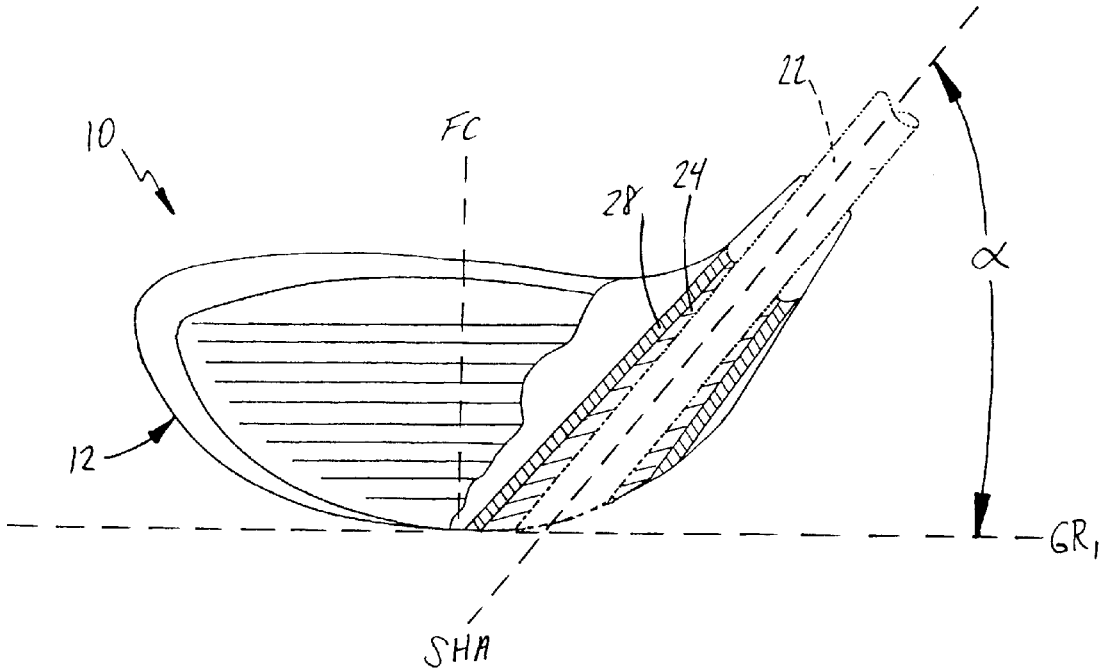
FIG. 6 shows another partial cross-sectional side view of the golf club of FIG. 1.

Referring now to FIGS. 5 and 6, a hosel 24 according to the present invention are shown for installation in a head 12. While hosels are depicted with respect to the embodiment of golf club 10, similar hosels may be used with respect to the embodiment of golf club 50. As shown in FIG. 5, hosel 24 has an upper face 60 and a lower face 62. As described above, hosel 24 is oblong in shape, tapering in size from lower face 62 to upper face 60. Preferably the center point 66 of upper face 60 is offset from center point 68 of lower face 62. In addition, preferably upper and lower faces 60, 62, respectively, are disposed in transverse planes and thus are not parallel to each other; lower face is flush with, and smoothly transitions with, sole portion 20 of head 12, as shown for example in FIG. 6. A through-bore 64 connects upper face 60 to lower face 62, and may be oriented at a variety of angles. For example, through-bore 64 may be aligned about central axis CA, which extends through center points 66, 68 of upper and lower faces 60, 62, respectively, at an angle $\theta_1$ with respect to the plane PLN defined by lower face 62. Through-bore 64 also may be aligned, for example, about an axis SQR which is disposed at an angle $\theta_2$ of about 90° with respect to plane PLN. In addition, through-bore 64 may be aligned along axis 70, which is disposed at an angle $\theta_3$ with respect to plane PLN.

As shown in FIG. 5, lower face 62 of hosel 24 may not have uniform wall thickness about through-bore 64. Depending on the angulation of through-bore 64, the wall thickness to one side of through-bore 64 may be significantly greater than the wall thickness to another side. Preferably, hosel 24 has a wall thicknesses that is greater than or equal to about 0.05 inch. Upper face 60 of hosel 24 may define a first area, while lower face 62 may define a second area. In one exemplary preferred embodiment of the present invention, the second area is greater than the first area.

Figure 7:
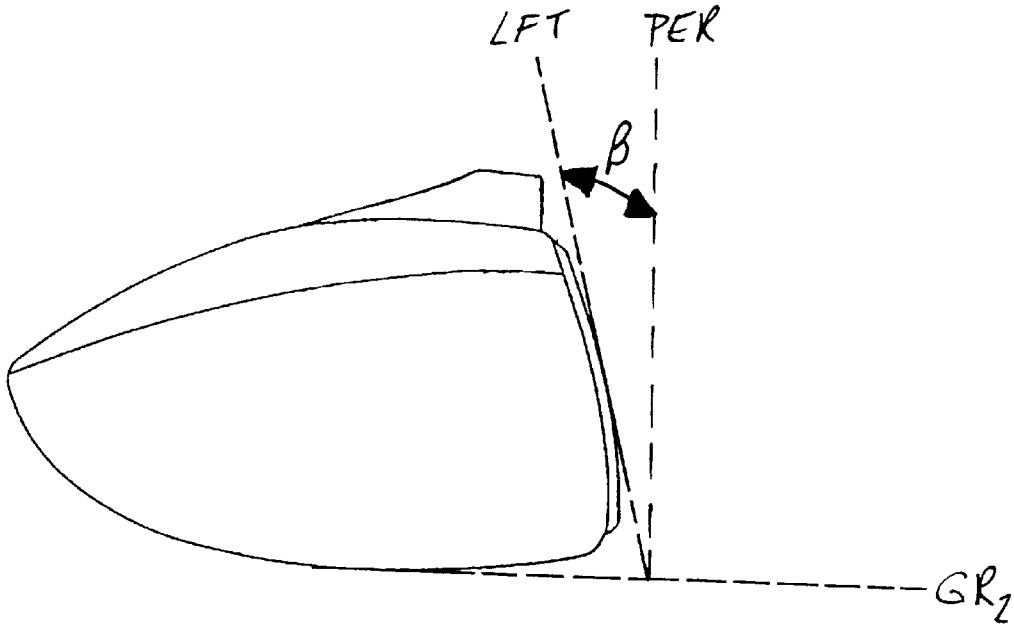
FIG. 7 shows another side view of the golf club of FIG. 1.

The range of angulations attainable with a through-bore 64 in hosel 24 permits selection of the lie angle $\alpha$, defined as the angle of the centerline SHA of shaft 22 with the ground line $GR_1$ tangent to sole portion 20 at face centerline FC. In addition, selection of a hosel 64 permits the loft $\beta$, defined as the angle of face portion 14 along a line LFT, running on the center of face portion 14, to a line PER that is perpendicular to sole portion 20 on ground line $GR_2$, as shown in FIG. 7. Preferably, use of hosels 24 permits selection of a lie angle $\alpha$ between about 40° and about 70° and a loft $\beta$ of between about 5° and about 40°.

Thus, custom fitting of golf clubs is permitted using a set of hosels 24 having through-bores 64 disposed at a variety of angles. A desired hosel 24 is selected from the set, and placed in hosel receiving tube 28 such that lower face 62 of hosel 24 is substantially flush with sole portion 20 of head 12. A shaft 22 is disposed in hosel 24, so that the lower end 72 of shaft 22 is substantially flush with lower face 62 of hosel 24 and sole portion 20 of head 12. Ferrule 26 may then be positioned along shaft 22 so that it abuts upper edge 30 of neck portion 16 of head 12, and may be affixed thereto to permit a generally smooth transition between head 12 and shaft 22.

Figure 8:
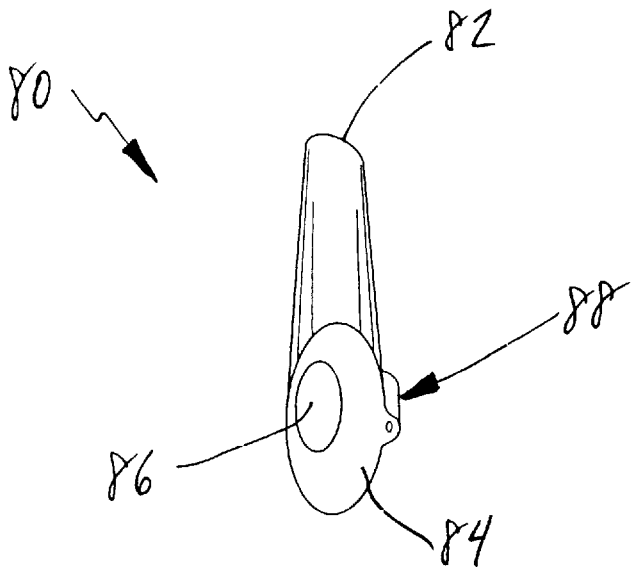
FIG. 8 shows another hosel according to the present invention.
Figure 9:
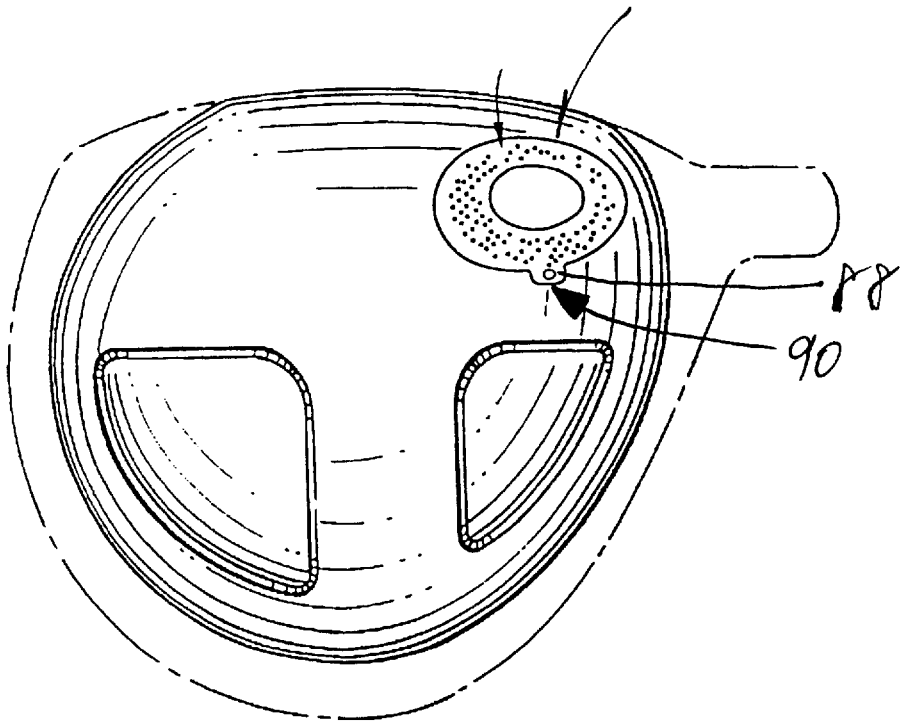
FIG. 9 shows a bottom view of the golf club of FIG. 1 with a keyed hosel partially received in a keyway.

In an alternate embodiment, shown in FIGS. 8–9, a keyed hosel 80 is shown. Hosel 80 has an upper face 82, a lower face 84, and is oblong in shape, tapering in size from lower face 84 to upper face 82. Upper and lower faces 82, 84, respectively, are not parallel to each other, so that lower face may smoothly transition with sole portion 20 of head 12, as shown for example in FIG. 9. A through-bore 86 connects upper face 82 to lower face 84, and may be oriented at a variety of angles. Hosel 80 includes a key 88, which fits in a keyway 90 formed in sole portion 20 at hosel receiving tube 28. While hosel 80 preferably is sized to be fully received in hosel receiving tube 28 in one orientation, the use of a key 88 and keyway 90 facilitates alignment of hosel 80 and provides a further positive lock between hosel 80 and head 12 so that hosel 80 is non-rotating when fully disposed in hosel receiving tube 28. While key 88 of hosel 80 is shown as an arcuate protrusion, other shapes are suitable for use with the present development such as rectangles. In an alternate embodiment, hosel 80 may be provided with a keyway 90, while at least one of hosel receiving tube 28 and sole portion 20 is provided with a keyed portion 88.

Figure 10:
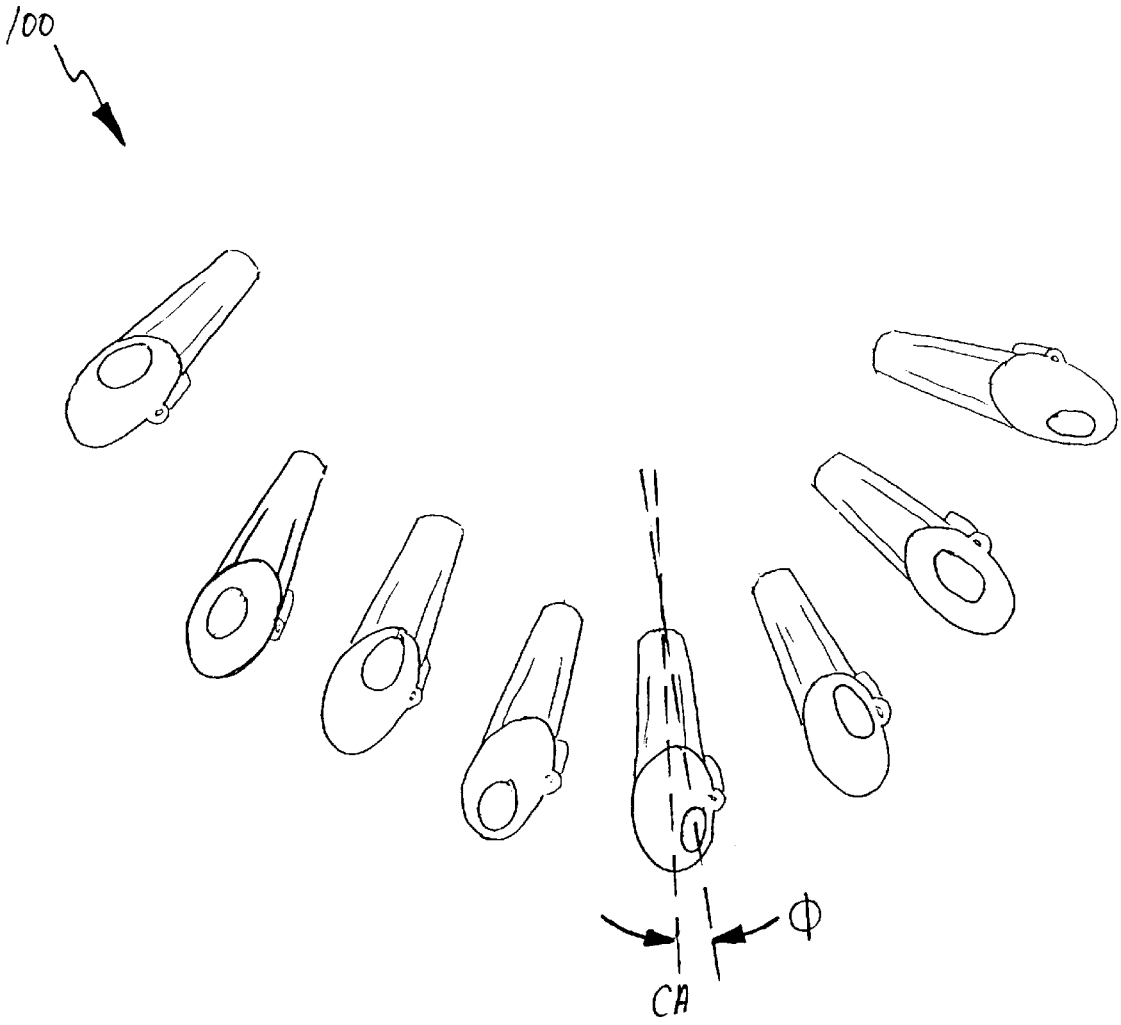
FIG. 10 shows a kit of hosels formed according to the present invention.

As shown in FIG. 10, a variety of hosels 80 may be provided in a set 100 to permit selection of the desired angulation of through-bore 86. The central axis CA is substantially the same for each hosel 80, while through-bores 86 are disposed at a variety of angles with respect thereto, such as angle $\phi$.

The hosel of the present invention may be configured and dimensioned to change the lie of a golf club, the face attitude of the golf club, or both the lie and face attitude of the golf club.

While various descriptions of the present invention are described above, it should be understood that the various features can be used singly or in any combination thereof. Therefore, this invention is not to be limited to only the specifically preferred embodiments depicted herein. Further, it should be understood that variations and modifications within the spirit and scope of the invention may occur to those skilled in the art to which the invention pertains. For example, although the embodiment described herein uses a single hosel for receiving a shaft, several hosels instead may be used. The hosels may be stacked one on top of the other, or a hosel may surround a second hosel in the form of a sleeve. In addition, while the embodiments shown herein do not include a separate crown plate or sole plate, one or both may be provided for use with the present invention.

Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A golf club comprising:

a metal wood club head comprising a body having a face, a neck, a crown, and a sole;

a hosel receiving tube having a first portion at the sole and a second portion proximate the neck;

a hosel configured and dimensioned to be received in the hosel receiving tube;

an elongate shaft configured and dimensioned to be received in the hosel, wherein the hosel has a substantially oblong and tapered geometry and is insertable into the hosel receiving tube from the sole.

2. The golf club of claim 1, wherein the hosel receiving tube is continuous.

3. The golf club of claim 1, wherein the hosel further comprises a top face and bottom face, wherein the bottom face rests flush with the sole when the hosel is fully disposed in the hosel receiving tube.

4. The golf club of claim 3, wherein the neck further comprises a top edge, and the top face of the hosel is disposed below the top edge when inserted into the hosel receiving tube.

5. The golf club of claim 3, wherein the neck further comprises a top edge, and the top face of the hosel is disposed proximate the top edge when inserted into the hosel receiving tube.

6. The golf club of claim 3, wherein the neck further comprises a top edge, and the top face of the hosel is disposed above the top edge when inserted into the hosel receiving tube.

7. The golf club of claim 6, wherein the hosel extends between about 0.075 inch and about 0.15 inch above the top edge.

8. The golf club head of claim 3, wherein the top face and bottom face are disposed in transverse planes.

9. The golf club of claim 3, wherein the top face has a first center point and the bottom face has a second center point, a central axis is disposed along the first and second center points, and the shaft is disposed in the hosel bore along a hosel bore axis.

10. The golf club of claim 9, wherein the hosel bore axis is transverse to the central axis.

11. The golf club of claim 9, wherein the hosel bore axis is parallel to the central axis.

12. The golf club of claim 1, wherein the hosel abuts a bore in the hosel receiving tube in a single orientation.

13. The golf club of claim 1, wherein the golf club has a lie angle between about 40° and about 70°.

14. The golf club of claim 1, wherein the golf club has a loft of between about 5° and about 40°.

15. The golf club of claim 1, wherein at least one of the hosel receiving tube and sole is configured and dimensioned to positively engage the hosel.

16. The golf club of claim 15, wherein a keyed portion of the hosel receiving tube mates with a keyway.

17. The golf club of claim 1, wherein the hosel is adhesively secured within the hosel receiving tube.

18. The golf club of claim 1, wherein the hosel is formed of at least one of cellulose, glass-filled ABS, graphite, thermoplastics, titanium, or aluminum.

19. The golf club of claim 1, further comprising a ferrule configured and dimensioned to receive the shaft and at least one of the neck and hosel.

20. The golf club of claim 19, wherein the ferrule comprises a rounded lower, outer edge, wherein the outer edge mates with a rounded shoulder proximate a top edge of the neck.

21. The golf club of claim 20, wherein the ferrule further comprises a straight sidewall.

22. The golf club of claim 1, wherein the hosel is configured and dimensioned to change the lie of the golf club.

23. The golf club of claim 1, wherein the hosel is configured and dimensioned to change the face attitude of the golf club.

24. The golf club of claim 1, wherein the hosel is configured and dimensioned to change the lie and the face attitude of the golf club.

25. A golf club comprising:

a metal wood club head comprising a body having a face, a neck, a crown, and a sole;

a hosel receiving tube having a first portion at the sole and a second portion at the neck;

a hosel configured and dimensioned to be received in the hosel receiving tube;

an elongate shaft configured and dimensioned to be received in the hosel; and a ferrule comprising a rounded lower, outer edge, the ferrule being configured and dimensioned to abut the shaft and the neck, wherein the hosel has an oblong and tapered geometry and is insertable into the hosel receiving tube from the sole, and the outer edge of the ferrule mates with a rounded shoulder proximate a top edge of the neck.

26. A golf club comprising:

a club head comprising a body having a face, a neck, a crown, and a sole;

a hosel receiving tube having a first portion at the sole and a second portion at the neck;

a hosel configured and dimensioned to be received in the hosel receiving tube, the hosel having a substantially oblong and tapered geometry, an upper face defining a first area and a lower face defining a second area; and an elongate shaft configured and dimensioned to be received in the hosel, wherein the hosel is insertable into the hosel receiving tube from the sole, the lower face of the hosel rests flush with the sole when the hosel is inserted into the tube bore, the second area is greater than the first area, and the club head is a driver or a wood.

* * * * *